US005910768A

United States Patent [19]

Ott

[11] Patent Number: 5,910,768

[45] Date of Patent: Jun. 8, 1999

[54] ANTI-THEFT DEVICE

[76] Inventor: Reinhold Ott, 6 Willow Street, Waterloo, Ontario N2J 4S3, Canada

[21] Appl. No.: 08/943,892

[22] Filed: Oct. 3, 1997

Related U.S. Application Data

[63] Continuation of application No. PCT/EP96/01493, Apr. 4, 1996.

[30] Foreign Application Priority Data

Apr. 4, 1995 [DE] Germany ..... 196 12 567
Feb. 12, 1996 [DE] Germany ..... 296 02 412 U

[51] Int. Cl.[6] ..... G08B 13/14

[52] U.S. Cl. ..... 340/568.2; 340/571; 340/539; 340/693.9; 340/693.5

[58] Field of Search ..... 340/568, 571, 340/572, 533, 539, 693, 531; 439/917

[56] References Cited

U.S. PATENT DOCUMENTS

| | | | |
|---|---|---|---|
| 3,932,857 | 1/1976 | Way et al. | 340/572 |
| 4,654,640 | 3/1987 | Carli et al. | 340/568 |
| 4,772,878 | 9/1988 | Kane | 340/568 |
| 4,855,713 | 8/1989 | Brunius | 340/506 |
| 4,945,341 | 7/1990 | Buttimer | 340/568 |
| 5,418,521 | 5/1995 | Read | 340/568 |
| 5,543,782 | 8/1996 | Rothbaum et al. | 340/568 |
| 5,552,771 | 9/1996 | Leyden et al. | 340/568 |
| 5,565,848 | 10/1996 | Leyden et al. | 340/572 |
| 5,570,080 | 10/1996 | Inoue et al. | 340/571 |
| 5,574,430 | 11/1996 | Ott et al. | 340/568 |
| 5,644,295 | 7/1997 | Connolly et al. | 340/568 |

FOREIGN PATENT DOCUMENTS

| | | |
|---|---|---|
| 0 171 459 | 2/1986 | European Pat. Off. . |
| 0 260 330 | 3/1988 | European Pat. Off. . |
| 33 02 459 | 11/1983 | Germany . |
| 89 07 641 | 9/1989 | Germany . |
| 44 01 325 | 6/1995 | Germany . |

*Primary Examiner*—Benjamin C. Lee
*Attorney, Agent, or Firm*—Barry R. Lipsitz

[57] ABSTRACT

A device for securing a goods article against theft is proposed, which is easy to produce, while also being extremely reliable and universally usable. This device comprises a first securing part for attachment to an object, a second securing part for attachment to the goods article and a cable connecting the two securing parts. At least one securing part comprises a sensor element for monitoring a proper attachment of the securing part to the object or the goods article, and at least one securing part comprises monitoring means, which are connected to the sensor element and are constructed so that an alarm may be triggered upon disruption of a proper attachment monitored by the sensor element.

36 Claims, 6 Drawing Sheets

152
158
156
154
162
160
150

ANTI-THEFT DEVICE

This is a continuation of international application PCT/EP96/01493 filed Apr. 4, 1996.

The present invention relates to devices for securing a goods article against theft, said devices comprising a first securing part for attachment to an object, a second securing part for attachment to the goods article and a cable connecting the two. In addition, the invention relates to systems for securing goods against theft.

Such securing devices are used primarily in retail stores for radio and television sets, video units, telephone systems or similar, in which a large number of appliances on display are ready for operation and are set up in readiness for testing by customers. In order to prevent losses of the displayed goods, or in particular of remote controls belonging to them, the goods are attached by said devices to an object such as a display shelf or a large unwieldy appliance. The cable connecting the two securing parts permits use of the secured appliance or secured goods article for testing by customers. The connection to the object prevents theft of the goods article, or at least renders it more difficult.

A device for mechanically securing a goods article against theft with the aforementioned features is known, in which the two securing parts are connected to one another via a thin plastic cable. The securing parts respectively have an attachment face with an adhesive layer, by means of which these are attached to an object or to a goods article to be secured. On the side remote from the attachment side, the securing parts have connection parts, which are formed on the one hand by a web with dovetailed cross-section and on the other hand by a complementary groove open on a face side. By means of these connection parts, a holding connection may be formed between the securing parts because the web-like connection part can be pushed longitudinally into the groove. This holding connection enables the secured goods article to be detachably connected to the associated object for attractive presentation.

A disadvantage with the known securing device is that a secured goods article can be stolen relatively easily, for example, by the cable connecting the securing parts being severed or by one of the securing parts glued to an object or the goods article being torn off. Consequently, the degree of protection against theft provided by the known device is inadequate especially for expensive goods.

It is additionally known, for example, from DE 33 02 459 to secure goods against theft by an electronic system. Such a system has a central unit, to which individual monitoring sensors to be attached to the goods to be secured may be connected via connection cables. The monitoring sensors respectively have a switching contact, which provides an electronic measurement variable upon detachment of a proper contact between the sensor and the goods article to be secured, which may be evaluated by the central unit as an alarm situation. Moreover, the central unit also monitors a proper connection of the sensor and indicates an alarm situation in cases of manipulation.

A disadvantage with the specified system is that each goods article to be secured must be connected to the central unit via a connection cable. This results in considerable expense for cabling and substantial lengths for connection, especially in larger retail stores. Moreover, because the connection cable generally runs along the floor, use of a secured goods article for testing is often rendered more difficult or even impossible.

The object of the invention is to provide devices with the aforementioned features as well as anti-theft systems, which allow the goods article to be secured against theft by easily produced, extremely secure and universally usable means.

A device according to the invention for securing a goods article against theft with the aforementioned features is distinguished by the fact that at least one securing part comprises a sensor element for monitoring a proper attachment of the securing part to the object or the goods article, and that at least one securing part comprises monitoring means, which are connected to the sensor element and are constructed so that an alarm may be triggered upon disruption of a proper attachment monitored by the sensor element.

Hence, a goods article can be secured against theft in a highly effective manner simply by one securing part being attached to the goods article to be secured and the other securing part being attached to an object, such as a large piece of furniture, a display shelf, an unwieldy appliance or other store fittings. Consequently, the goods article can be secured in virtually any desired location and optimum presentation of the goods article may be achieved without problem, in which case in particular testing and handling of the goods article by customers is made possible within the scope of freedom of movement provided by the connection cable.

The monitoring of the proper attachments of the securing parts to the goods article or to the object by means of the sensor elements and the monitoring means results in a particularly reliable detection of attempted thefts and thus a substantial improvement in theft protection compared to the prior art.

In a first preferred embodiment, the monitoring means comprise a connection to a central monitoring circuit or central unit, which is housed in a special device. The connection can be an electrical connection by means of a plug connection or an electric cable, but an optical or radio connection is also possible. What is important in the case of the connection is merely that upon disruption of a proper attachment of a securing part to a goods article and/or an object monitored by the sensor element, it can transmit the fault signal of the sensor to the central unit so that this can trigger an alarm.

It is conceivable here that where several devices according to the invention are used, each device comprises a connection, via which a further device may be connected so that a series connection of the devices may be formed via the electrical connections or connection cable, whereby only one of the devices may be connected and monitored with the central unit directly, and the others may be connected and monitored through interposing one or more identical devices.

In a second embodiment, the monitoring means comprise a monitoring circuit arranged in a securing part and which can trigger the alarm upon disruption of a proper attachment monitored by the sensor element.

In this case, the sensor element does not necessarily need to be arranged on/in the securing part itself. Instead, it may be provided that the sensor element is connected via an electrical connection to the securing part, and spatially separate from this, may be attached to the object or the goods article. Such an "external" sensor element may, of course, be used in addition to a sensor element integrated into the securing part.

An alternative device for securing a goods article against theft according to the invention with the aforementioned features is provided if each securing part comprises a sensor element for monitoring a proper attachment of the securing parts to the object or the goods article, and that at least one securing part is constructed so as to be connected to a central unit so that upon disruption of a proper attachment monitored by the sensor elements, an alarm may be triggered by monitoring means in the central unit.

This device also enables a goods article to be secured against theft in a highly effective manner with a substantial freedom of movement for use of the secured goods article for testing. Moreover, in the case of monitoring of the connection of the device to the central unit, theft of both the goods article and the object may be detected and thus prevented. Even when the device is connected to the central unit by means of a lead, the cabling expense is substantially lower then conventional goods protection systems, in which a connection cable with a sensor at its end is directed from a central unit to each object and each goods article.

A particularly preferred embodiment provides that the monitoring means are only arranged in one securing part or the central unit and are connected to the sensor element in the other securing part via the cable connecting the two securing parts. In this case, with the assistance of the two sensor elements, the monitoring means still arranged in one securing part monitor both the attachment of the one securing part to an object and the attachment of the other securing part to the goods article to be secured. As soon as one of the proper attachments is disrupted, an alarm is triggered by the monitoring means. In this way, a very simple arrangement is achieved since a cable connecting the two securing parts is still provided and monitoring means are still necessary in a securing part. Alternatively, however, it is also possible to arrange monitoring means in each securing part which can monitor a proper attachment of the securing part by means of the respective sensor element and in the case of manipulation can trigger an alarm independently of one another. In this case, the cable connecting the two securing parts in particular forms only a mechanical connection between these.

There are several alternatives for connection of the cable to the securing parts. For instance, the cable can be screwed, glued or soldered to the securing parts.

An advantageous embodiment results if the cable may be joined to the securing parts respectively by plug connection. This makes it very simple to configure the device according to requirement by plugging a cable of appropriate length into the securing parts, and in particular this may be carried out on site by the user. Moreover, the arrangement permitting plug connection allows different securing parts, which are, for example, specially adapted for attachment to specific goods or objects, to be combined with one another according to requirements. The plug connection can be formed by standardised plugs and sockets, such as western plugs and sockets or similar. In a special arrangement, it is thereby provided that the plug connection cannot be re-released so that the cable cannot be released from the securing parts again after the protection device has been configured in accordance with requirements. Unintentional triggering of an alarm as a result of unintentional disconnection of the plug connection during testing of the secured goods article by customers is therefore avoided.

In an arrangement where the cable may be plugged into the securing parts, the monitoring means are advantageously constructed so that an alarm may be triggered upon disruption of a proper plug connection of the cable to the securing part. Hence, in particular when the monitoring means are arranged in both securing parts, a proper cable connection between these is monitored by means of a disconnection of one of the plug connections of the cable and securing part causing the alarm to be triggered. In an appropriately sturdy construction of the cable, the measure of monitoring this for a proper connection through a conductor loop extending over the entire cable can then be omitted.

However, it is provided in a preferred configuration that the monitoring means are constructed so that an alarm may be triggered upon disruption of the proper cable connection between the securing parts. For this, a closed power circuit causing an alarm to be triggered upon interruption is formed, for example, from the monitoring means in one securing part beyond the cable to the sensor element in the other securing part and back again. Thus, it is monitored whether a proper cable connection is present between the securing parts. In this case, the concept of disruption of the proper cable connection should be understood to mean in particular any manipulation, i.e. also a short-circuit of the power circuit, for example.

Because a securing part comprises a surface element for attachment to the object or the goods article, a proper attachment, achieved in particular by gluing, can be easily formed.

Optimum adaptation to curved surfaces is achieved in that the surface element is of flexible construction. Hence, a very durable attachment of the securing part to the object or to the goods article to be secured may be achieved, as a result of which unintentional disruption of the attachment, and therefore false alarms, are avoided.

The surface element comprises an adhesive layer for attachment of the securing part to an object or a goods article. The adhesive layer formed in particular by a double-sided adhesive strip enables a very simply produced attachment of the securing part, whereby no additional securing means such as adhesive are necessary. In this case, the securing part with its surface element is in particular constructed so as to withstand stress so that in the case of disruption of the proper attachment through removing the securing part from the goods article or the object, the possibility of destroying the surface element is excluded, even if the adhesive layer is torn or detached from the surface element. Hence, it is absolutely possible to renew the adhesive layer, and possibly the allocated sensor element, when a detached securing part or the device is re-used.

A simple formation of the device according to the invention is generally possible if a sensor element is constructed so that upon disruption of the monitored proper attachment, a measurement variable is changed and its change may be evaluated by the monitoring means as an alarm situation. In particular, this concerns an electrical measurement variable, the change in which is recorded so that the evaluation and possibly triggering of the alarm can be performed by an electronic circuit of the monitoring means. However, alternatively, the measurement variable can also be formed by the pressure of a gas, for example, the change in which may be transmitted via the hollow cable between the securing parts.

A very sensitive variant is distinguished by the sensor element of the securing part comprising a wire strain gauge associated with the flexible surface element. Hence, even extremely small changes in the shape of the flexible surface element may be detected upon manipulation of the proper attachment, as a result of which an extremely high security against manipulation may be achieved.

A quite particularly preferred variant, which is very simple and inexpensive to produce and is also extremely reliable in operation, results if the surface element comprises an adhesive layer for attachment of the securing part to the object or the goods article, which adheres more strongly to the object or the goods article than to the surface element, and that the allocated sensor element is arranged, at least in sections, in such a way between the surface element and the adhesive layer, or in the latter, that upon disruption of the proper attachment, the sensor element is separated from the securing part at least partially with the adhesive layer, and thus a measurement loop formed by the sensor element is interrupted.

In this case, it is provided in particular that the adhesive layer has predetermined breaking points. These can be formed by perforations or incisions in the adhesive layer, for example. Thus it is ensured that the adhesive layer, and with it also the sensor element, is destroyed when the securing part is removed from the object or the secured goods article, and as a result an alarm is triggered by the monitoring means.

In this case, the sensor element preferably comprises an electrical, in particular metal foil type, conductor loop. Such a conductor loop has the advantage that interruption of the power circuit formed by the conductor strip may be detected at very low expense. As well as being inexpensive to produce, a metal foil type construction of the conductor loop results in a particularly flat structure of the sensor element. Moreover, flat abutment of the conductor loop against the adhesive layer and accordingly a good adhesive connection of the conductor loop result, so that upon detachment of the securing part from the goods article to be secured, adhesion of the conductor loop to the adhesive layer at least partially detaching from the contact surface element is assured. In the case of manipulation, this results in the prescribed destruction of the conductor loop and thus to reliable detection of the attempted theft.

Further advantages of a thin, foil-like structure of the sensor element relate to the fact that the sensor element is very flexible, so that high flexibility overall may be achieved if the surface element or the entire securing part is of flexible construction. A further advantage is that a foil is destroyed by only a slight application of force in the case of the adhesive layer being detached from the sensor, and therefore a particularly reliable detection of attempted thefts results.

As an alternative to the foil-type construction of the conductor loop, this may also be formed by a vapour-deposited metal layer or a very thin wire. Moreover, predetermined breaking points can be provided in order to assure the prescribed interruption of the conductor loop upon detachment of the securing part from the adhesive layer.

A further variant is distinguished by the surface element comprising an adhesive layer for attachment of the securing part to the object or the goods article, which adheres more strongly to the object or the goods article than to the surface element, and that the sensor element is constructed and arranged on the securing part in such a way that upon disruption of the proper attachment, the adhesive layer is at least partially separated from the securing part and this is detected by the sensor element. This results in the advantage that irrespective of the concrete construction of the sensor element, e.g. as microswitch or photosensitive element, the securing part can be prefabricated insofar as only a protective foil usually attached to the adhesive layer has to be removed and the securing part has to be adhered to the goods article to be secured for protection against theft. An unintentional triggering of an alarm is thus prevented even in the case where the surface is not optimally smooth. An alarm is triggered only when the adhesive layer is detached from the surface element, possibly facilitated by predetermined breaking points, in the case of an attempted theft, since the sensor element detects the detachment from the securing part of surface element.

A very inexpensive arrangement results where the sensor element of a securing part comprises a microswitch.

According to an alternative embodiment, the sensor element comprises a photosensitive element, which may be formed by a phototransistor, for example. When the securing part is properly attached to the object or the goods article, this element is covered either by the adhesive layer or by an abutting surface of a goods article to be secured or an object to the secured. When the securing part is detached from the surface, ambient light falls on the photosensitive element so that a measurement variable provided by this is changed and the change may be evaluated by the monitoring means as an alarm situation.

In a preferred variant in the case where a securing part comprises a surface element for attachment to the object or goods article, it is provided herein that the photosensitive element is arranged in the securing part so that the optical axis of the element forms an acute angle of preferably less than 45° with the attachment face formed by the surface element. This results in a particularly high sensitivity of the sensor element in the detection of an alarm situation, since in this embodiment light striking obliquely against the attachment face is detected particularly reliably by the photosensitive element with its obliquely aligned optical axis as soon as the securing element is detached laterally from the goods article to be secured or the object to be secured.

In a particularly advantageous configuration, it is thereby provided that the optical axis of the photosensitive element intersects an essentially central region of the attachment face. Hence, the risk given with an edge-side alignment of the optical axis that no adequate optical seal against the ambient light is achieved, depending on the surface structure of the goods article to be secured, is counteracted since the photosensitive element essentially responds to the incidence of light in the region of the centre of the attachment face.

In the case of an oblique alignment of the optical axis of the photosensitive element, a possibility is to arrange several elements in the securing part so that their axes point in different directions in order to achieve an optimum response sensitivity of the sensor element.

Moreover, a sensor element having at least one photosensitive element can also comprise a light source, such as an infrared diode or LED, which is arranged in a recess of the securing part so that the light exit through the adhesive layer or a surface of the object to be secured or the goods article to be secured may be covered in a light-tight manner. This configuration ensures that when the securing part is detached from the goods article or the object, reflections on the surface or adhesive layer disengaging from the attachment face of the surface element lead to an illumination of the photosensitive element and thus to a particularly reliable detection of each attempted theft which is independent of ambient light.

In a further alternative embodiment of particularly small structure, the light source and the photosensitive element form a structural unit and are arranged in a recess of the securing part in such a way that upon proper attachment of the securing part, light signals emitted by the light source can be reflected on the adhesive layer covering the recess and detected by the photosensitive element. Upon disruption of the proper attachment, the adhesive layer is detached from the contact surface element at least in the region of the recess so that the detected light signal is changed and an alarm situation is recognised.

It should be noted in particular that a securing part with a sensor element according to one of the above alternative embodiments can also be used individually as a monitoring sensor, which may be connected directly via a cable to a monitoring circuit in a central unit to form an anti-theft system.

The securing parts preferably comprise connection means for the formation of a detachable holding connection between the securing parts. In the simplest case, the two securing parts may be connected to one another via a touch and close fastening, reusable adhesive tape, holding magnets or similar. Moreover, it is possible to detachably connect the secured goods article to the associated object for attractive presentation. In particular, the securing parts in this case assume a defined relative position to one another so that especially with a plurality of secured goods articles, a uniform arrangement is achieved when the connection is formed between the respective securing parts belonging together. In order to prevent an unwanted detachment of the holding connection, and thus prevent damage to the secured goods article, the connection means are constructed so that a positive holding connection is formed between the securing parts which has a correspondingly high load-bearing capacity. A very simple means of forming the holding connection, and thus a very simple manner of handling the device, are achieved if the connection means are constructed so that one securing part can be coupled into the other.

The monitoring means preferably comprise an energy storage means for energy supply. This can be formed, for example, by an accumulator or a battery. Therefore, the device may be used independently of the mains and the device may be used universally, since no power supply leads whatsoever are necessary. Alternatively or in addition hereto, solar cells may also be used as energy supply.

Preferably, at least one securing part comprises an optical display for the operating status of the device. In this case, the light-emitting diodes of very small design are particularly suitable.

The optical display is preferably operated in the function in which it displays a manipulation of the attachment of the securing part to the goods article or object continuously, i.e. until the alarm is turned off by authorised staff. In the case of an alarm, this makes it easier for the sales staff to locate the goods article which has been the subject of an attempted theft. In any case, a proper attachment of the securing part can also be formed again very quickly.

Alternatively or additionally thereto, the optical display is operated so that it emits an optical signal such as a flashing signal upon proper attachment of the securing part in order to make potential thieves aware of the anti-theft monitoring system and deter them from theft.

Moreover, the optical display can naturally also be used to display other information such as a properly re-established attachment of the securing part, for example, by illuminating the display briefly.

In one embodiment, the monitoring means comprise an alarm unit for the emission of an acoustic and/or optical signal. In particular, this unit comprises a piezoelectric crystal. Such a crystal requires relatively little space and therefore a low structural height of the securing part may easily be achieved. Moreover, the piezoelectric crystal can generate a very loud alarm signal, if required, effecting reliable recognition of an attempted theft. Alternatively, the alarm unit may also comprise a small loudspeaker for generation of an alarm signal.

In another alternative embodiment of the device, it is provided that a securing part of the device for securing goods may be connected to a monitoring circuit of an anti-theft system and/or further securing parts via a connection cable. As a result of this, the proposed device may be combined with a conventional anti-theft system or additional securing parts for securing further goods. Even when a cable connection is provided between the first securing part and the anti-theft system, customers are provided with a better opportunity of testing out the secured goods article than with conventional solutions, since this may be freely moved within the scope of freedom of movement allowed by the cable connected to the two securing parts without the cable leading to the anti-theft system lying on the floor, for example, being lifted and thus posing a considerable risk of accident.

In a further alternative embodiment, the monitoring means comprise a transmitter for emission of a transmission signal indicating an alarm situation. This enables the device according to the invention to be integrated into an anti-theft system with a central, very powerful alarm display.

It is provided in particular thereby that the monitoring means are constructed so that the transmission signal is encoded for identification of the device. Hence, in a corresponding arrangement of a central unit receiving the transmission signal, it is possible to identify the device which has detected an attempted theft. Accordingly, it is possible, especially when a plurality of goods securing devices are used, to definitely identify the securing device causing the alarm to be triggered.

A system for securing goods against theft according to the invention is distinguished by at least one device for securing the goods with a transmitter for emission of a transmission signal indicating an alarm situation and by a central unit, which comprises a receiver for wireless receipt of the transmission signal and for detection of an alarm situation, and an alarm unit for emission of an acoustic and/or optical alarm signal. Such an anti-theft system according to the invention also allows a theft protection system which may be produced at low expense in extensive retail locations. Hence, the receiver unit may be set up centrally, e.g. in the vicinity of a cash desk or similar. The individual devices for securing goods are attached to the respective goods to be secured and corresponding objects such as shelves, or fixed to fittings connected to the structure of the building. Because of the wireless signal transmission, cabling is not necessary and therefore only a low expense is required for securing goods with a central monitoring system.

Each attempted theft is detected by the monitoring means of the respective device, and a transmission signal indicating an alarm situation is emitted. This is received by the receiver of the central unit and is evaluated as an alarm situation so that an acoustic and/or optical alarm is provided by means of the activatable alarm unit. Hence, the sales staff in particular may be made aware of the attempted theft and prevent the theft. The central arrangement of the means displaying the alarm in this case allows a particularly powerful design of the alarm unit, whereby the plurality of goods securing devices can be produced from very inexpensive and small components with a low power requirement. This results in low production costs for the entire anti-theft system.

In the case of use of a plurality of goods securing devices, it is provided that these each have monitoring means which can emit a transmission signal encoded for identification of the device in the case of an alarm situation, and the receiver unit of the anti-theft system comprises a decoder including an activatable display, so that the device detecting an alarm situation can be identified and displayed on the basis of its transmission signal. Hence, in the case of an alarm, the sales staff are provided with the possibility of identifying the goods securing device triggering the alarm without delay through the display, so that a potential thief can be located and caught very quickly, especially in an extensive retail location.

In this case, a very simple internal fixture of the individual identification code for the devices securing the goods is permitted if the receiver unit and the devices for securing the goods are constructed so that the identification code of each device may be recognised by the decoder in the case of first time or test emission of a coded transmission signal by the device, and may be stored for later identification in the case of an alarm situation.

Another anti-theft system according to the invention is distinguished by at least one of said devices for securing goods as well as a central unit, which as monitoring means comprises at least one monitoring circuit, to which the device or its monitoring or sensor means can be connected by means of a connection cable and which can detect an alarm situation, and an activatable alarm unit for emission of an alarm signal. With such an anti-theft system, in the case of a specific number of goods and objects to be secured by a respective securing part, there may be reduction in the necessary cable connections to the anti-theft system, which is in particular arranged further away, since at least two securing parts are connected to the anti-theft system via each of these cable connections.

The invention is explained in more detail below on the basis of the drawing of several embodiments, wherein.

Figure 1:
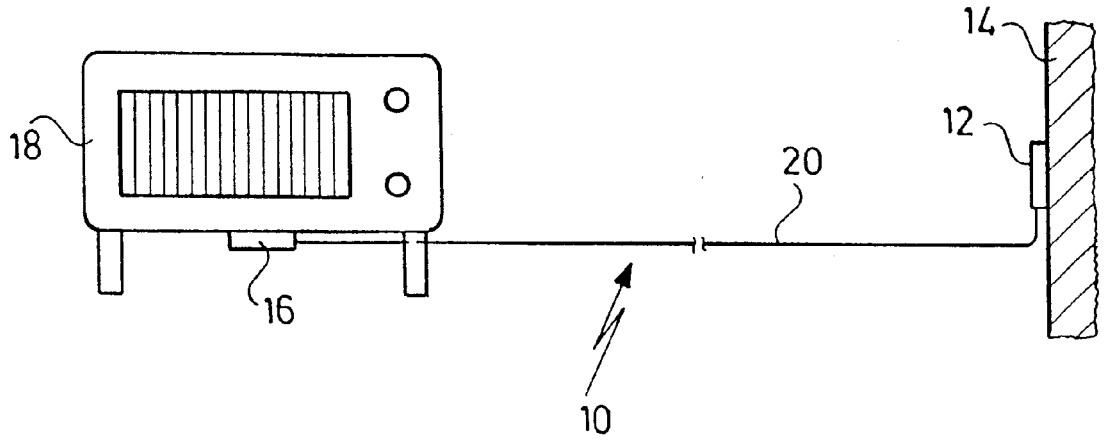
FIG. 1 is a basic sketch of a first embodiment of a device for securing goods.

The device according to the invention for securing a goods article against theft shown in the drawing is given the reference numeral 10 in general. The device 10 has a first securing part 12 for attachment to an object 14, a second securing part 16 for attachment to a goods article 18 to be secured and a cable 20 connecting the two securing parts 12 and 16.

In a first embodiment according to FIG. 1, the first securing part 12 is attached to an object 14 in the form of a wall. The second securing part 16 is attached to a goods article 18 to be secured in the form of a radio by gluing the second securing part 16 onto its underside. Hence, the presentation of the goods article 18 is not impaired for customers. The device 10 arranged in this manner already constitutes a mechanical means of securing the goods article 18 against theft. Moreover, the device 10 has a monitoring system for the proper attachments of the securing parts 12 and 16 to the object 14 or the goods article 18, which is explained in more detail in the subsequently described embodiments on the basis of the further figures.

Figure 2:
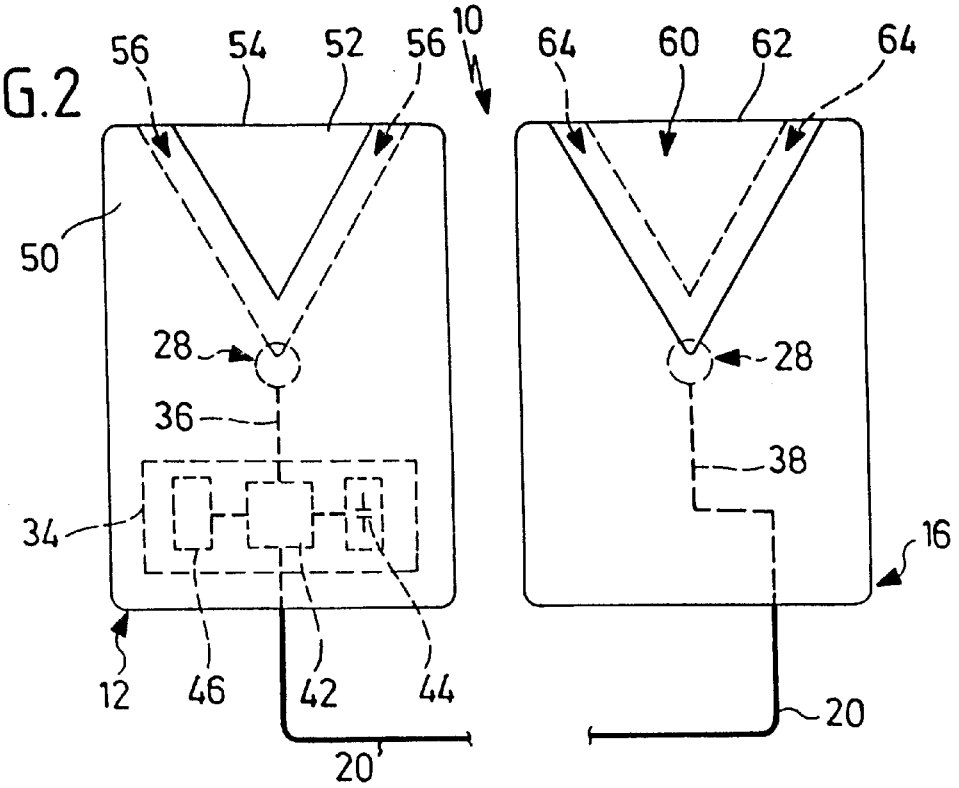
FIG. 2 shows a side view of a second embodiment of a device for securing goods with separate securing parts.
Figure 3:
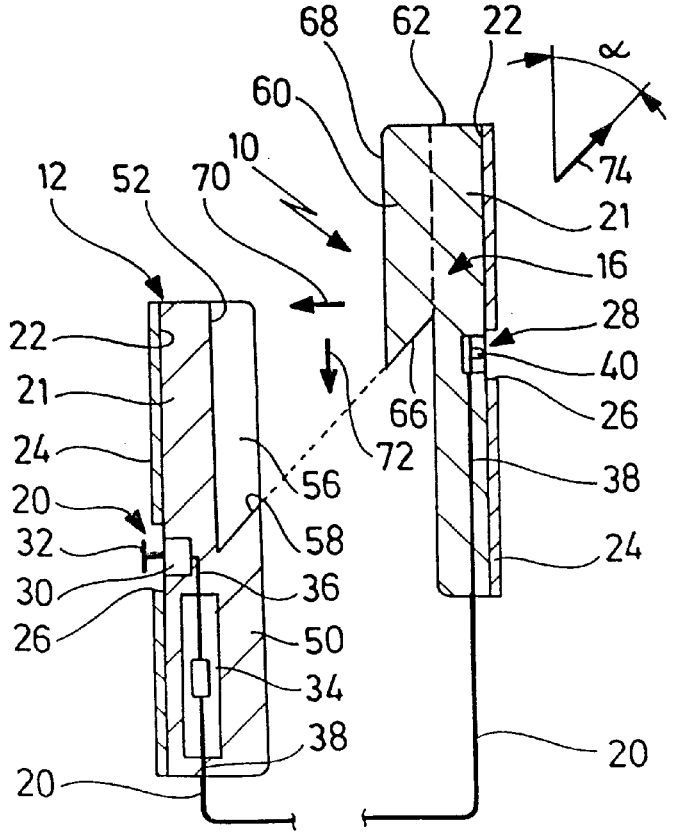
FIG. 3 is a sectional representation of a device according to FIG. 2 with opposing securing parts.

In a further embodiment of the device 10 according to the invention shown in FIGS. 2 and 3, the securing parts 12 and 16 respectively comprise connection means, which may be brought into engagement with one another so that a fixed, releasable holding connection may be formed between the securing parts 12 and 16. These connection means will be explained more precisely later.

In this embodiment, the two securing parts 12 and 16, which are mechanically connected to one another via the flexible cable 20, essentially have the respective form of a flat parallelepiped, whereby on one of its flat sides, the first securing part 12 has a surface element 21 with an attachment face 22, to which an adhesive layer 24 is applied for attachment of the securing part 12 to an object not shown in FIGS. 2 and 3. Also on one flat side, the second securing part 16 has a surface element 21 with an adhesive layer 24, which serves for attachment of the second securing part 16 to a goods article to be secured (not shown).

Both adhesive layers 24 are formed by a double-sided adhesive tape and have a perforation 26 in the region of their centre. A sensor element 28 is respectively inserted into the corresponding surface element 21 for monitoring the proper attachment of the securing parts 12, 16 in the region of these perforations 26.

As sensor element 28, the first securing part 12 has a microswitch 30, the actuating part 32 of which extends through the perforation 26 of the adhesive layer 24 and protrudes beyond the adhesive face of the adhesive layer 24 facing the object, as is evident from FIG. 3.

Moreover, the first securing part 12 comprises monitoring means 34, which are arranged in a corresponding recess, which is closed, for example, by a cover, of the first securing part 12. The monitoring means 34 are connected to the sensor element 28 of the first securing part 12 via electric leads 36 and to the sensor element 28 of the second securing part 16 via electric leads 38, which extend through the cable 20 and into the second securing part 16. Therefore, the cable 20 here serves not only as a mechanical connection but also as an electrical connection of the two securing parts 12, 16 or their electrical components.

In the example shown in FIGS. 2 and 3, the sensor element 28 of the second securing part 16 is formed by a photosensitive element 40, such as a photo-diode or a phototransistor, which is inserted into the surface element 21 of the second securing part 16 so that light passing through the perforation 26 of the adhesive layer 24 is detected by the photosensitive element 40.

The monitoring means 34, which in this embodiment are arranged only in one, namely the first, securing part 12, comprise an evaluation unit 42, which evaluates the electrical measurement variables supplied by the sensor elements 28 with respect to an alarm situation. The monitoring means 34 further comprise an energy storage means 44 in the form of a battery or an accumulator for the energy supply, and also an alarm unit 46 for the emission of an acoustic alarm signal, which may be actuated by the evaluation unit 42 and comprises a piezoelectric crystal, which is arranged so that in the case of an alarm, it can emit an acoustic alarm which can be readily heard from the outside.

The use and function of the device 10 will be described below. In this case, it must be noted that a distinction is made between a first securing part 12 and a second securing part 16 in the shown example according to FIGS. 2 and 3. This is as a result of the connection means associated with the securing elements 12, 16 for formation of a holding connection, which will be explained in more detail later. The monitoring means 34 can, of course, be selectively arranged in one of the two securing parts 12 and 16 or also in both.

The first securing part 12 is glued by means of its adhesive layer 24 onto a surface of an object (not shown), which is not at risk from theft, such as a large, unwieldy device, a display shelf or similar. As a result of this, a proper attachment of the first securing part 12 is formed on the object, because the actuating part 32 is pressed in by the surface of the object coming into abutment against the adhesive layer 24 and the switching point of the microswitch 30 is exceeded. The sensor element 28 of the first securing part 12 thus detects a proper attachment of the latter. The switching status of the microswitch 30 is reflected in an electrical measurement variable, by means of which the monitoring means 34 recognise an alarm situation.

The second securing part 16 is glued onto a goods article to be secured, which is not shown in FIGS. 2 and 3, for the formation of a proper attachment of the second securing part 16 to the goods article. Because of the surface of the goods article coming hereby into abutment against the adhesive layer 24, the recess 26 of the adhesive layer 24 and with it the photosensitive element 40 are covered in a light-tight manner or are at least substantially darkened. The photosensitive element 40 makes an electrical measurement variable characteristic for this covered state available which may be evaluated by the evaluation unit 42 of the monitoring means 34 as a state of proper attachment of the second securing part 16 on the goods article to be secured. Accordingly, the sensor element 28 of the second securing part 16 also makes an electrical measurement variable available which displays a proper attachment of the second securing part 16.

After proper attachment of both securing parts 12 and 16, the monitoring means 34 are activated. This can be achieved, for example, via a pushbutton or a switch for switching on the energy supply through connecting the energy storage means 44 to the evaluation unit 42. It is preferably provided that the evaluation unit 42 is activated through an activation current flowing over one or both of the sensor elements 28 which is switched on upon formation of a proper attachment.

The monitoring means 34 henceforth monitor a proper attachment of the two securing parts 12 and 16 on the object or the goods article by the evaluation unit 42 checking the electrical measurement variables made available by the sensor elements 28 for the respective alarm criteria. These alarm criteria can be provided, for example, by a specific change in the electrical resistance, a voltage change or a current change, whereby the alarm criteria can, moreover, be fixed individually or uniformly, depending on the sensor elements 28 used.

If, in the case of an attempted theft, a proper attachment of one of the securing parts 12, 16 to the object or the goods article is disrupted, for example, by the adhesive contact between the adhesive layer 24 and the corresponding surface being disengaged, the measurement variable made available by the sensor element 28 undergoes a change which meets the alarm criteria. Thus, in the case of the photosensitive element 40, upon detachment of the second securing part 16 from the goods article to be secured, light falls onto the photosensitive element 40, which leads to a corresponding change in the measurement variable. Upon detachment of the first securing part 12 from the object, the actuating part 32 of the microswitch 30 jumps out again beyond the abutment face formed by the adhesive layer 24, and the microswitch 30 thereby changes its switching status and with it a measurement variable made available by it.

Each of these changes in measurement variables is recognised by the evaluation unit 42 of the monitoring means 34 as an alarm situation, and the alarm unit 46 is actuated so that a loud alarm signal sounds, which indicates disruption of a proper attachment of one of the securing parts 12, 16.

The configuration shown in FIGS. 2 and 3 of the sensor elements 28 as microswitch 30 and as photosensitive element 40 should merely be seen as an example for representation. These embodiments can, of course, be used respectively as required in one or both of the securing parts 12, 16 or other detectors or sensor elements 28 described later. Moreover, it is also possible to cover the sensor element 28 arranged in the surface element 21 with the adhesive layer 24, so long as this is constructed so that upon disruption of the proper attachment, the adhesive layer 24 adheres more strongly to the object or goods article than to the surface element 21, and is consequently detached from the latter. The removal of the adhesive layer 24 from the securing part 12, 16 is then detected by the sensor element 28 in the case of an attempted theft.

A further essential characteristic of the invention is that the arrangement of the monitoring means 34 in a securing part 12 and their in particular electrical connection to a sensor element 28 in the other securing part via the cable 20 also results in monitoring of the cable connection between the securing parts 12, 16. Thus, an alarm signal is triggered upon disruption of the proper cable connection, since the measurement variable supplied by the sensor element 28 arranged in the other securing part 16 is necessarily changed in cases of manipulation at the cable 20, such as interruption or short-circuiting.

The structure and function of the connection means allocated to the securing parts 12 and 16 for the formation of a detachable holding connection will now be discussed.

On its flat side facing away from the surface element 21, the first securing part 12 has a first connection part 50 which is constructed in one piece with the securing part 12.

The connection part 50 is plate-shaped and has essentially the same flat parallelepipedal shape as the first securing part 12. The first connection part 50 has a recess 52 which corresponds essentially to the flat frustum of a three-sided irregular pyramid, the base surface of which faces the flat side of the first securing part 12. The recess 52 is arranged on the side edge of the connection part 50, i.e. on a face side 54, which lies opposite the attachment point of the cable 20 to the first securing part 12. The head surface of the frustum of the pyramid lies in the flat side of the first connection part 50 facing away from the first securing part 12, so that said connection part defines the recess 52 through two undercut sections 56, which form leading surfaces 58 converging towards one another in a V shape and on an incline to the flat side.

On its flat side opposite the surface element 21, the second securing part 16 has a second connection part 60 connected in one piece with this, which is constructed as a flat frustum of an irregular three-sided pyramid, which is connected at its head face to the flat side of the second securing part 16. The second connection part 60 is constructed to be essentially complementary to the first connection part 50, i.e. corresponds approximately to the recess 52 in its form. Moreover, the second connection part 60 on the second securing part 16 is arranged so as to correspond to the recess 52 on the first securing part 12, the projecting second connection part 60 thus extends from a face side 62 of the second securing part 16, which lies opposite an attachment point of the cable 20 to the securing part 16, with side faces converging towards one another in a V shape towards the centre of the flat side of the second securing part 16. These side faces constitute undercut sections 64, which form leading surfaces 66 inclined to the flat side of the second securing part 16 and thus also to its surface element 21.

The securing parts 12 and 16 with their connection parts 50 and 60 are respectively injected in one piece from plastic so that a simple production of the device 10 is made possible.

For use of the connection means formed by the two connection parts 50 and 60, the first securing part 12 is glued by means of its adhesive layer 24 onto a surface running obliquely to the horizontal or a vertically extending surface of an object for attachment of the first securing part 12 to the object. In this case, the first securing part 12 is aligned so that the recess 52 lies at the top and the face side 54 of the first securing part 12 allocated to the recess 52 runs essentially horizontally.

The second securing part 16 is connected by means of an adhesive layer 24 to a goods article to be secured (not shown).

To form the holding connection between the securing parts 12 and 16, the second securing part 16 is coupled by its second connection part 60 into the recess 52 formed by the first connection part 50. For this, the second securing part 16 is moved with its second connection part 60 first and flat sides aligned approximately parallel to the first securing part 12 to the first connection part 50 until the second connection part 60 strikes against the first securing part 12 with its head face 68 facing away from the second securing part 16 in the region of the recess 52. This relative movement between the two securing parts 12 and 16 is carried out essentially perpendicular to the two surface elements 21 of the securing parts 12 and 16 held approximately parallel to one another in the direction of the arrow 70.

With its second connection part 60 on the first securing part 12, the second securing part 16 then slides essentially parallel to the surface elements 21 downwards in the direction of the arrow 72, whereby the undercut sections 56 and 64 respectively converging towards one another act as insertion slopes and facilitate the formation of a rear engagement between them. Thus, the undercut sections 56 and 64 of the securing parts 12 and 16 finally come into abutment against one another and a rear engagement between the two connection parts 50 and 60 is formed over the entire longitudinal extension of the undercut sections 56 and 64. The positive holding connection of the two securing parts 12 and 16 formed in this way is capable of bearing a substantial load, so that the goods article arranged on the second securing part 16 is securely held by the object supporting the first securing part 12.

Moreover, an attractive presentation of the secured goods article is assisted by the defined relative position of the two securing parts 12 and 16 to one another when the holding connection is formed, since this goods article is set down again intuitively by the customer after testing and visual inspection with formation of the holding connection.

To detach the holding connection, the second securing part 16 can be moved upwards from the first securing part 12 in the opposite direction to the arrow 72, or be moved away from the first securing part 12 in the direction of the arrow 74 on an oblique upward incline because of the inclination of the undercut sections 56 and 64. In this case, because of their incline in relation to the surface element 21 of the first securing part 12 and as a result of their angle position to one another, the leading surfaces 58, 66 fix the inclination of the obliquely upward directed movement of detachment 74, at which the leading surfaces 58, 66 can slide off one another upon detachment of the holding connection.

The necessary inclination of the movement of detachment according to the invention in relation to a surface normal of the attachment face 22 of the first securing part 12 causes the weight to act against detachment of the holding connection where the first securing part 12 is arranged as prescribed on a vertically extending surface of the object. Hence, a goods article held and secured by the second securing part 16 is prevented from being detached unintentionally and thus from being dropped unintentionally.

The respective arrangement of the undercut sections 58 and 66 on the connection parts 50 and 60 on the edge side allows the coupling movement in the direction of the arrow 72 to deviate very severely from the movement of detachment in the direction of arrow 74. However, formation and detachment of the holding connection can be achieved through a relative movement of the two securing parts 12 and 16 to one another within one direction, which lies in an angle range $\alpha$ which is restricted by the movement of detachment in the direction of arrow 74, on the one hand, and by a movement running against the coupling direction 72, on the other. Therefore, it is very simple to form or detach the holding connection, since no exactly defined direction of movement has to be adhered to, instead the said angle range $\alpha$ is available for the relative movement.

The inclined leading surfaces 58, 66 allow detachment of the holding connection through a detachment force perpendicular to the attachment face 22 of the first securing part 12, and directed away from this, acting on the second securing part 16. Through the inclination, a force component running in direction 74 results which leads to a corresponding movement of detachment of the second securing part 16 relative to the first 12. Hence, the secured goods article can be picked up by customers as a result of a force directed against arrow 70, i.e. a force directed away from the object, with detachment of the holding connection of the two securing parts 12, 16.

A further variant of a securing part, given the reference numeral 80, will be described below on the basis of FIGS. 4 and 5.

In contrast to the embodiments shown in FIGS. 2 and 3, the shown securing part 80 comprises a flexible housing 82 made of an elastic material. The housing 82 has an integrated surface element 84 with a flexible smooth attachment face 86, which forms a flat side of the housing 82.

In the shown embodiment, the housing 82 is essentially constructed as a flat parallelepiped with rounded edges. The attachment face 86 corresponds to a base face of the parallelepiped. However, the housing 82 can also have the form of a flat section of a circular cylinder or an elliptic cylinder or another form. What is important is that a flexible surface element 84 is formed.

A rigid connection part 88 is cast into the housing 82 to which the cable 20 is connected for connecting to another securing part (not shown). The connection part 88 here serves as a firm mechanical connection of the cable 20 to the securing part 80 as strain relief, on the one hand, and as an electrical connection of the sensor element 28 arranged on the securing part 80 via electrical leads 38, on the other. Since the connection part 88 is completely enclosed by the housing 82, the cable 20 in the shown embodiment is also partially cast into the housing 82 and thus firmly mechanically connected to this. Alternatively, however, the cable 20 can also be connected by plug connection to the housing 82 and the connection part 88.

The connection part 88 is constructed very flat and runs with its main plane of extension essentially parallel to the attachment face 86. The connection part 88 has two contact points 90 in the form of contact pins, which respectively extend through the surface element 84 up to the attachment face 86 and are possibly slightly elevated beyond the attachment face 86.

The contact points 90 serve as electrical connection of the sensor element 28 arranged on the attachment face 86. In the embodiment according to FIGS. 4 and 5, the sensor element 28 lies flat on the attachment face 86.

Figure 5:
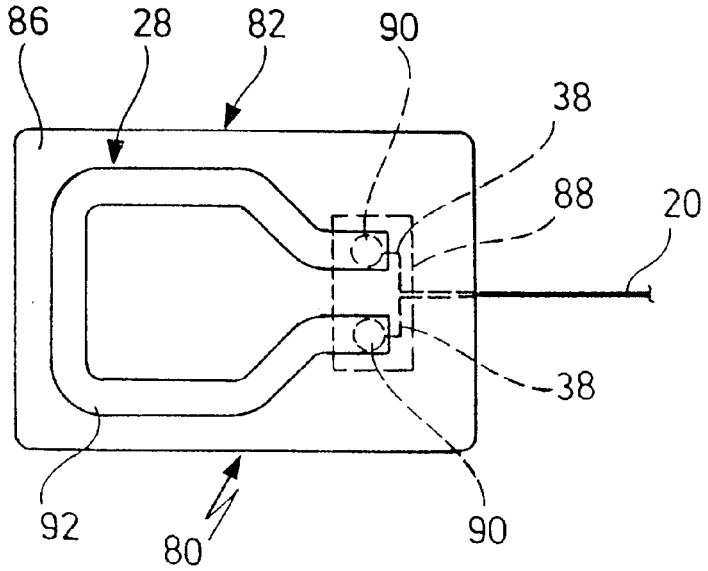
FIG. 5 is a view of the securing part in FIG. 4 from below.

In the shown example according to FIG. 5, the sensor element 28 is formed by a conductor loop 92 lying on the attachment face 86 which is made of a aluminium metal foil strip here arranged at a distance and running approximately parallel to the edge of the attachment face 86 of the surface element 84. In this case, the conductor loop 92 forms an essentially open U and respectively covers one of the contact points 90 of the connection part 88 with the free leg ends.

Because the conductor loop 92 lies on the contact points 90, electrical contacting of the conductor loop 92 occurs. In order to create a good contact between the contact points 90 and the conductor loop 92, the contact points 90 are preferably constructed so as to be slightly elevated in relation to the attachment face 86. Moreover, the surfaces of the contact points 90 are preferably coated with gold in order to assure a low transition resistance to the conductor loop 92.

Alternatively, the conductor loop 92 is formed by an appropriately vapour-deposited metal sheet, e.g. made of silver, which can be vapour-deposited on the contact points 90 for electrical contacting.

Figure 4:
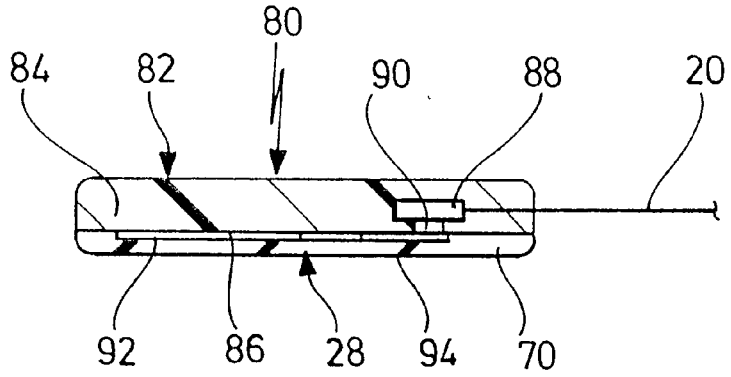
FIG. 4 is a sectional representation of a third embodiment of a securing part.

It is evident from FIG. 4 that the sensor element 28 is fully covered by an adhesive layer 96 on the attachment face 86 of the securing part 80. This adheres both to the attachment face 86 and to the sensor element 28. In FIG. 5 the illustration of this adhesive layer has been omitted for reasons of clarity.

The adhesive layer 96 is formed by a double-sided adhesive tape which on its adhesive face 94 facing away from the surface element 84 is covered by a protective foil (not shown) until it is attached to a surface of an object or goods article to be secured.

An alternative formation results if the conductor loop 92 is attached to the side of the adhesive layer 96 facing the attachment face 86 prior to the adhesive layer 96 being attached to the surface element 84 in order to assure a good adhesive connection between the conductor loop 92 and the adhesive layer 96. In this case, the contact points 90 may also be of resilient construction to assure a very good electrical contact.

In the embodiment according to FIGS. 4 and 5, the sensor element 28 is arranged between the adhesive layer 96 and the securing part 80 or the surface element 84 formed by this.

FIG. 5 indicates that the cable 20 respectively directs a lead 38 to the contact points 90. A closed power circuit is formed by the conductor loop 92 via the contact points 90, the connection leads 38 and the cable 20, which the monitoring means 34 (not shown here) monitor.

In the embodiment shown in FIGS. 4 and 5, the monitoring means 34 for monitoring a proper attachment of the securing part 80 are arranged in another securing part connected to the securing part 80 via the cable 20. This securing part can then be constructed, depending on the purpose of use, in keeping with that in FIGS. 4 and 5 or also in keeping with an embodiment shown in FIGS. 2 and 3. The necessary monitoring means can, of course, also be enclosed by the securing part 80 and arranged in its housing 82, in particular in the connection part 88.

In a border case, the housing 92 is constructed so flat that it is identical to the surface element 84. The electrical connection of the sensor element 28 can then be achieved by gluing the cable 20 between the surface element 84 and the adhesive layer 96, or solely into the latter, and connecting it to the sensor element 28. Hence, an extremely low thickness of the securing part 80 of only a few millimetres can be achieved.

For formation of a proper attachment to an object or a goods article, the securing part 80 is glued onto a surface of the object or the goods article by means of the adhesive face 94 of the adhesive layer 96 with the protective foil (not shown) removed. Because of the flexible construction of both the sensor element 28 and the surface element 84 including the housing 82, the securing part 80 can be adapted to any desired arched or curved surface. To form a proper attachment to the adhesive face 94, the securing part 80 is glued over its whole area onto the surface, which is preferably formed by an underside of the goods article or the object, so that the appearance of the object or the goods article is impaired only minimally.

A proper attachment of a further securing part (not shown) connected via the cable 20 to the securing part 80 is performed in like manner. After activation of the monitoring means 34, which are not shown in FIGS. 4 and 5, but are shown in FIGS. 2 and 3, has been accomplished, the device 10 according to the invention protects the goods article provided with a securing part against theft.

If, in an attempted theft, the securing part 80 is detached from the goods article or the object, the adhesive layer 96 with the sensor element 28 or the conductor loop 92 remains glued to the goods article or the object. It is still possible to remove the surface element 84 from the adhesive layer 96. For this, the adhesive layer 96 has a higher holding or adhesive power on the adhesive face 94 than with respect to the surface element 84. Accordingly, when the securing part 28 is removed from the goods article or the object, the measurement loop formed by the sensor element 28, in this case the electrical conductor loop 92, is interrupted. The conductor loop 92 and/or the adhesive layer 96 may additionally have predetermined breaking points, such as tapered sections, perforations or incisions, if necessary, for defined interruption.

This destruction of the sensor element 28 as prescribed in the case of a manipulation constitutes a most essential characteristic of the embodiment which assures a particularly reliable detection of an attempted theft.

The interruption leads to a clear change in the measurement variable made available by the measurement loop, which is recognised by the evaluation unit 42 as an alarm situation. In this case, the evaluation unit 42 emits a signal triggering an alarm to the alarm unit 46, which in consequence causes an alarm signal to be emitted.

It goes without saying that the flexible securing part 80 may also be fitted with other types of sensor elements 28, such as a microswitch 30 or a photosensitive element 40.

Figure 6:
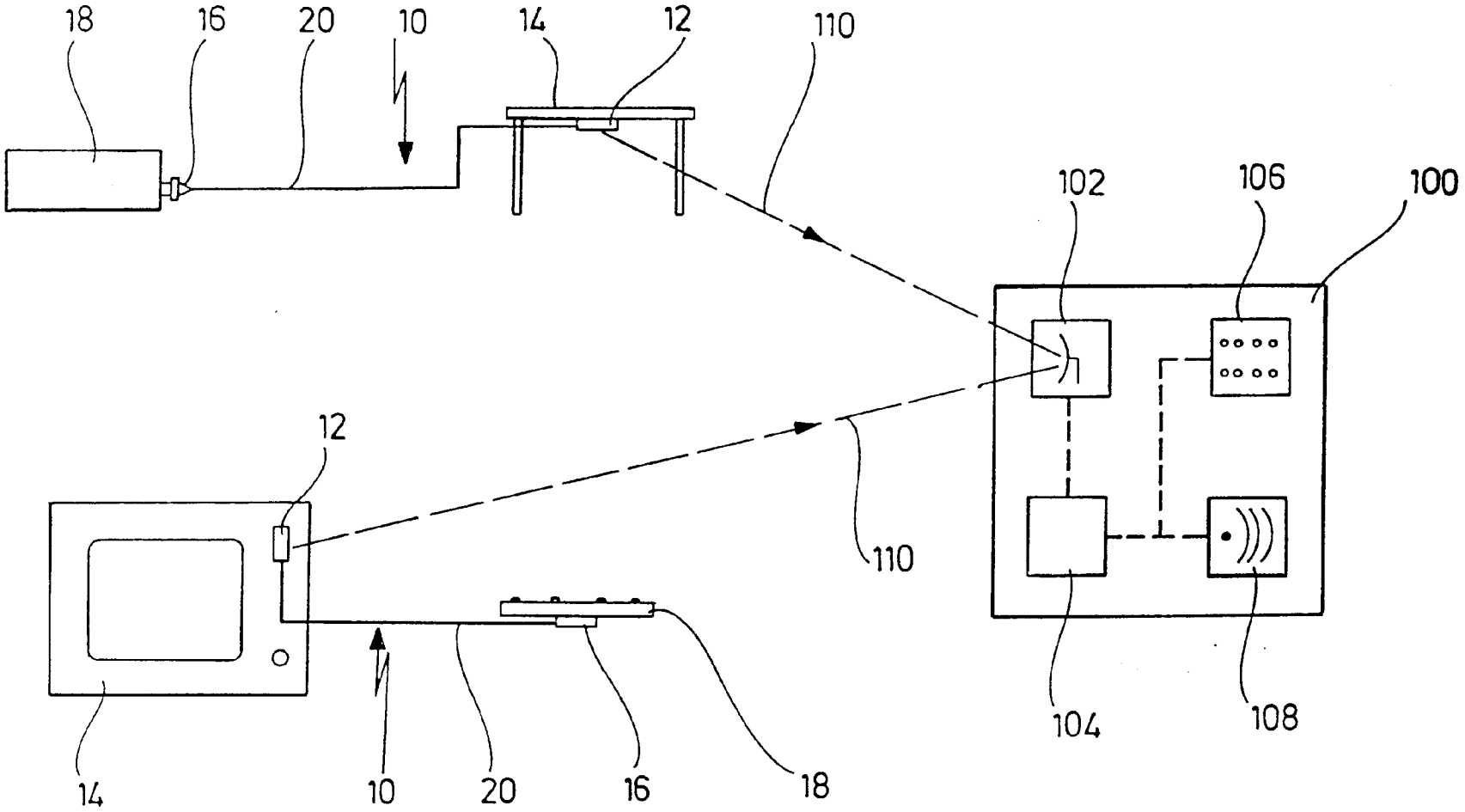
FIG. 6 is a schematic representation of an anti-theft system according to the proposal with two devices for securing goods and a central unit.

FIG. 6 shows an anti-theft system according to the proposal. This comprises at least one modified device 10 according to the proposal for securing a goods article against theft as well as a central unit 100. In the shown example, two devices 10 are shown which both respectively comprise two securing parts 12 and 16 connected via a cable 20.

The securing part 12 of the device 10 shown at the top in FIG. 6 is attached to an object 14 in the form of a table. The other securing part 16 is constructed as a computer plug sensor which is plugged onto a standard connection of a personal computer as the goods article 18 to be secured.

In the case of the device 10 at the bottom, one securing part 12 is attached to a television, which forms an object 14 for securing the goods article. The other securing part 16 is glued onto the rear side of a remote control forming the goods article 18 to be secured.

Each of the securing parts 12, 16 comprises a sensor element 28 (not shown) for monitoring a proper attachment to the respective goods article 18 or the respective object 14. The measurement variables made available by these sensor elements 28 are monitored to ascertain the occurrence of an alarm situation by means of monitoring means 34 (not shown) respectively arranged in the securing parts 12 in the shown example.

The modification of the devices 10 with respect to the embodiments shown in FIGS. 1 to 5 is based upon the monitoring means 34 comprising a transmitter (not shown) instead of the alarm unit 46, said transmitter being able to be actuated by the evaluation unit 42 so that, when an alarm situation occurs, it can emit a wireless transmission signal 110, indicated in FIG. 6, which is received by the central unit 100.

Each sensor of the monitoring means 34 is constructed in this case so that transmission is possible without problem even over longer distances. Transmission can occur via ultrasonic, infrared or radio signals, in which case a radio signal has the advantage that neither visual contact between the transmitter and receiver nor a special alignment of the transmitter and receiver relative to one another is necessary.

The transmitters of the monitoring means 34 are respectively constructed so that in the case of an alarm situation, these emit transmission signals 110 containing an identification code for unequivocal identification of the device 10 emitting the signal.

The central unit 100 comprises a receiver 102, a decoder 104, a display device 106 and an alarm unit 108 for emission of an alarm signal.

The receiver 102 is equipped to receive the transmission signal 110 emitted by a device 10 in the case of an alarm situation.

The decoder 104 decodes the identification code of the respective device 10 contained in the received transmission signal 110 and actuates the display device 106 so that in an alarm situation, the device 10 concerned is displayed. For this, the display device 106 has a series of light-emitting diodes, which respectively correspond to a specific device 10. In an alarm situation, the light emitting diode corresponding to the device emitting a signal 110 is illuminated. Hence, in the case of an alarm, it is possible to immediately recognise through the display device 106 which device 10 an alarm situation has been detected in.

The alarm unit 108 may be actuated either by the decoder 104 or, alternatively, directly by the receiver 102, and in the case of an alarm situation, generates an acoustic and/or optical alarm signal. For this, the alarm unit 108 can comprise a siren or a flashing lamp, for example.

The described anti-theft system according to the invention can comprise an almost unlimited number of devices 10 for securing individual goods articles against theft. Since no cable connection is necessary between the devices 10 and the central unit 100, the anti-theft system may be used universally and in particular also for large retail locations. Moreover, the devices for securing goods 10 can be adapted optimally to the respective goods to be secured by selecting appropriate securing parts and sensor elements.

In order to set up an unequivocal identification system when setting the anti-theft system in operation, the devices 10 are constructed so that they can emit a transmission signal 110 with an encoded identification code for test purposes. When an identification code occurs for the first time at the encoder 104, this is stored and allocated to a predetermined, or to the next free display space of the display device 106. Moreover, the alarm unit 108 may be switched off in a test mode of the central unit 100. Through test transmission of the transmission signal 110 of the devices 10, it may then be established which display space of the display device 106 corresponds to which device for securing goods 10.

Figure 7:
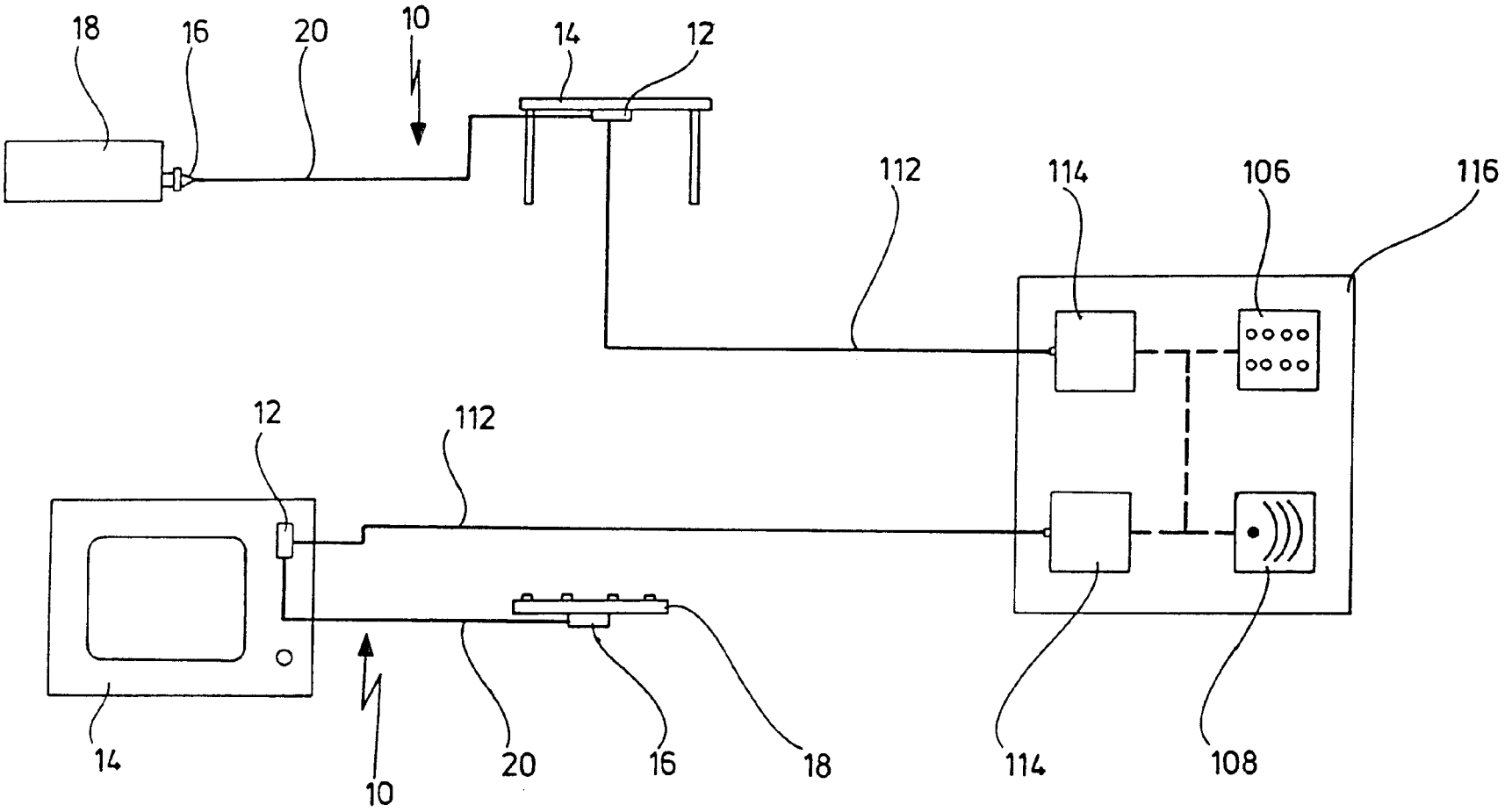
FIG. 7 is a schematic representation of an alternative anti-theft system with two devices for securing goods and a central unit.

In contrast to FIG. 6, FIG. 7 shows an anti-theft system, in which the devices 10 for securing goods are modified such that the first securing part 12 may be respectively connected via a connection cable 112 to a monitoring circuit 114 in the central unit 116. For example, the connection cable 112 is fitted with corresponding plug elements for this purpose, so that electrical plug connections may be formed respectively both to the first securing part 12 and to the monitoring circuits 114 in the central unit 116.

Either the monitoring circuits 114 evaluate the signals which are made available by the respective monitoring means 34 of the included devices 10 for detection of an alarm situation, or the monitoring circuits 114 assume the function of the monitoring means 34, so that these may be omitted in devices 10.

In the case of an alarm situation each monitoring circuit 114 triggers an alarm independently of the others through actuation of the alarm unit 108.

In addition, the monitoring circuits 114 can respectively comprise an activation circuit, which allows connection of a device 10 with an alarm being triggered, but causes an alarm to be triggered when the connection to the respective device 10 is severed.

Otherwise, the anti-theft system according to FIG. 7 corresponds to that in FIG. 6, and therefore reference is made to the full contents of the description thereof.

In a further modification of the device 10 for securing goods, it can be provided that further securing parts 12, 16 or 80 may be connected via cable 20 to each, and in particular to the first securing part 12, so that a kind of local distributor is formed, whereby the first securing part 12 can respectively form a connection to the central unit 100 or 116 upon formation of an anti-theft system according to the proposal.

A further variant of a securing part 120 will be described below on the basis of FIG. 8. It comprises a housing 122, which may be made from an elastic material, if necessary, and thus be flexible. The housing 122 has an integrated surface element 124 with a flexible smooth attachment face 126 which forms a flat side of the housing 122. An adhesive layer 128, which serves as a means of self-adhesive attachment of the securing part 120 to the surface of a goods article to be secured or an object to be secured, is glued on the attachment face 126.

The securing part 120 is connected to another securing part (not shown) via the cable 20. The securing part 120 can, if necessary, also have connection possibilities for further securing parts.

In the shown example, the sensor element 28 comprises a photosensitive element 40 arranged in a recess 130 of the securing part 120. The recess 130 extends from the attachment face 126 obliquely into the interior of the surface element 124 or the housing 122 in such a manner that the optical axis 132 of the photosensitive element 40, i.e. its main direction of detection, forms an acute angle $\beta$ with the attachment face 126, which is in particular smaller than 45°. Moreover, the recess 130 is aligned so that the axis 132 runs essentially towards the centre of the attachment face 126 starting from the photosensitive element 40 or intersects a central region 142 of the attachment face 126.

This alignment of the photosensitive element 40 leads to an improved response behaviour to light striking obliquely against the attachment face 126, such as occurs in cases of attempted manipulation, if the properly attached securing part 120 is firstly detached laterally and in this case ambient light falls laterally on the attachment face 126.

The response behaviour of the sensor element 28 can be further improved if several photosensitive elements 40 are used and are aligned at their optical axes 132 in different directions, e.g. in a star shape relative to the attachment face as projection plane.

In the shown example, the adhesive layer 128 has perforations corresponding to the opening of the recess 130 so that a light-tight covering of the photosensitive element 40 is achieved in the properly attached state of the securing part 120. Alternatively, the adhesive layer 128 is constructed to be continuous so that an alarm situation is detected when the adhesive layer 128 is detached from the attachment face 126 and as a result, ambient light, possibly through reflection on the side of the adhesive layer 128 facing the attachment face 126, can strike against the photosensitive element 40.

Figure 8:
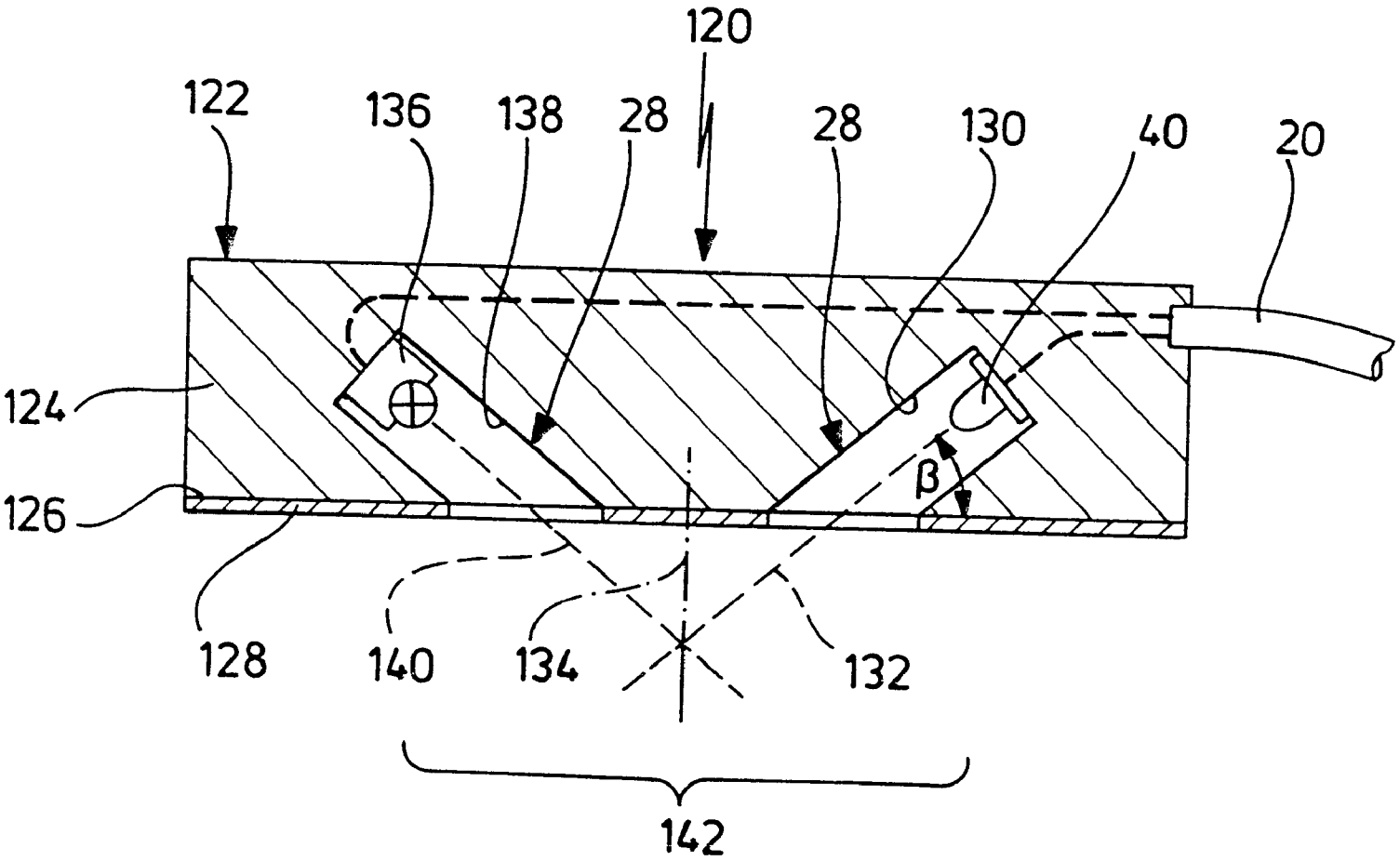
FIG. 8 is a sectional representation of a further embodiment of a securing part.

A quite especially reliable detection of attempted thefts is achieved with the embodiment of the securing part 120 shown in FIG. 8 in that the sensor element 28 additionally comprises a light source 136, which may be formed, for example, by a light-emitting diode, in particular pulsed for the purpose of saving power, and is arranged in a recess 138, corresponding to the recess 130 and arranged axially symmetric to a surface normal 134 of the attachment face 126, in the surface element 124 or in the housing 122 of the securing part 120. Like the photosensitive element 40, the light source 136 is connected via cable connections (only indicated in broken lines) and the cable 20 to the monitoring means 34 (not shown) or directly to the monitoring circuit 114 for power supply, on the one hand, and for discharging a detection signal, on the other.

The recess 138 is constructed and the light source 136 aligned in such a way that its main direction of emission 140 in the shown example according to FIG. 8 runs essentially axially symmetric to the axis 132 relative to the surface normal 134.

The additionally provided light source 136 allows the detection of cases of attempted manipulation independent of ambient light, since when the securing part 120 is properly attached, the light source 136 is either covered so as to be light-tight by a surface of the goods article or the object in the embodiment, or alternatively by the adhesive layer 128. Only when the proper attachment state is removed can the light of the light source 136 exit from the recess 138 and enter the recess 130, possibly upon reflection on the surface or adhesive layer 128, and strike against the photosensitive element 40 so that its ready measurement signal is changed and an alarm situation is signalled instead.

It must be pointed out that the described variant of the securing part 120 allows a particularly sensitive detection of cases of attempted manipulation, and therefore an extremely high degree of theft protection can be achieved. It is also possible, in particular, to use the securing part 120 or the other described variants individually as monitoring sensor, whereby each sensor is connected directly to an anti-theft system via a connection cable 112 and is attached at its attachment face 126 to a goods article to be secured.

Figure 9:
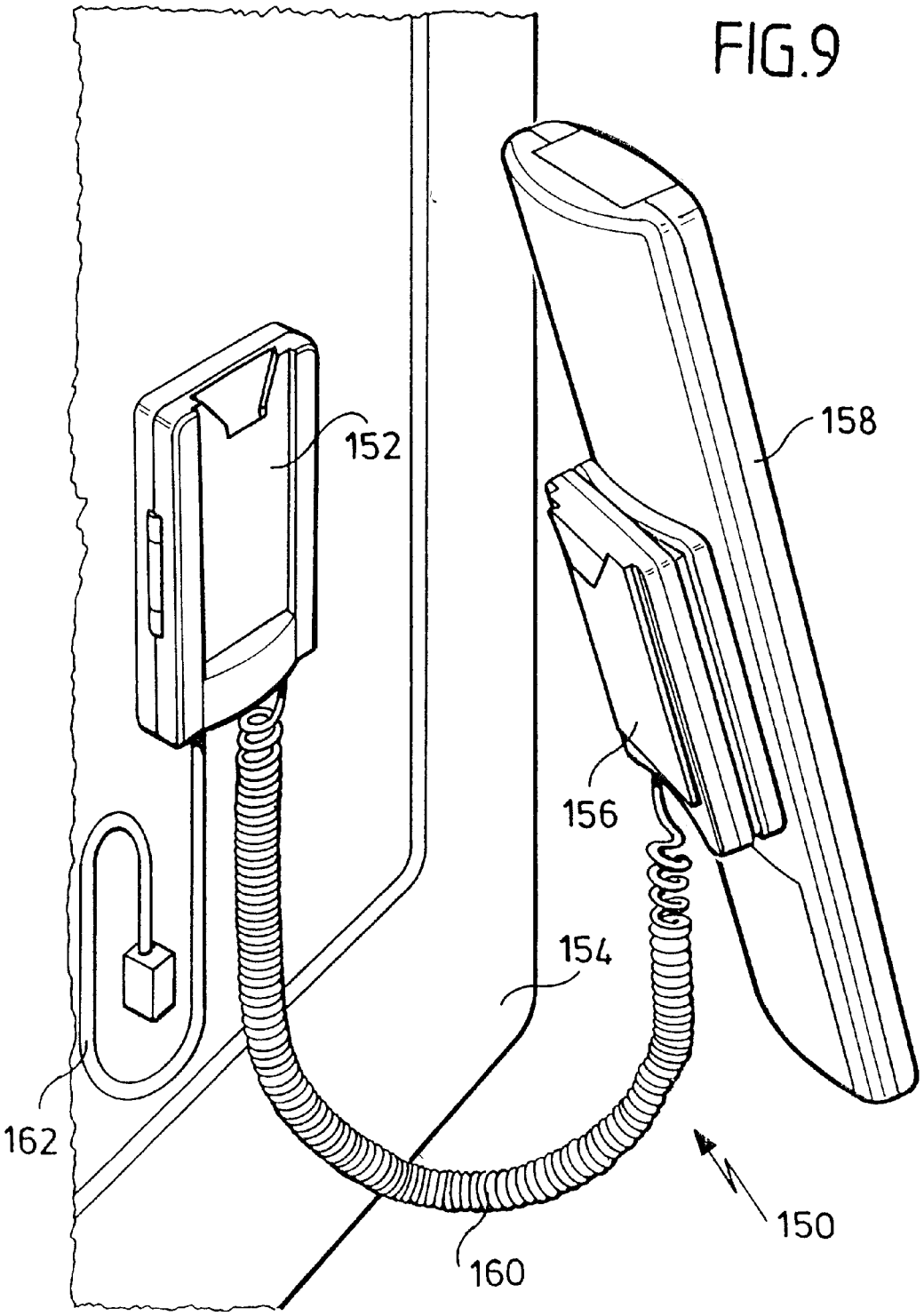
FIG. 9 shows a further embodiment of a device according to the invention.

Finally, FIG. 9 shows a further embodiment of a device 150 according to the invention, in which a first securing part 152 is attached to a television set 154 (object) and a second securing part 156 is attached to a corresponding remote control (goods article) 158. The proper state of the attachment of the second securing part 156 to the remote control 158 is monitored via a sensor element (not shown), which is constructed as a microswitch and arranged in the securing part 156, and which indicates an alarm state in the case where the proper state of the attachment is disrupted. The alarm state indicated by the sensor element is forwarded on via an electrical connection cable 160 between the first and the second securing part 152 and 156 respectively. An electrical connection cable 162 leads from the first securing part 152 to a central unit (not shown) with a monitoring circuit, which triggers alarm upon transmission of the alarm state signal from the sensor element. In this embodiment, only a single sensor element is necessary in the device.

In order to prevent many, and in some instances long, connection cables having to be directed to the central unit in the case of a plurality of goods articles to be monitored, it may be provided that the device according to the invention is fitted with a connection, e.g. a plug socket, on the securing part to be attached to the object, to which an electrical connection cable 162 of an identical device according to the invention used adjacent thereto can be connected. Hence, a plurality of devices 150 according to the invention may be connected in series, whereby a first device 150 in the series is connected to the central unit and passes the alarm state of each of the devices/securing part sensor element connected in series on to the central unit. This permits a particularly simple and orderly cabling layout upon use of a plurality of devices according to the invention with a single central unit.

I claim:

1. A device for securing a goods article against theft, said device comprising:

a first securing part for attachment to a substantially flat surface of an object, a second securing part for attachment to a surface of the goods article, a cable connecting the first and second securing parts, at least one of said securing parts having a sensor element for monitoring a proper attachment of the securing part to the surface to which it is attached;

at least the other one of the securing parts having monitoring means connected to the sensor element via said cable and constructed so that an alarm is triggered upon disruption of at least one of the cable and a proper attachment monitored by the sensor element; and connection means for providing a detachable holding connection between said securing parts.

2. A device according to claim 1, wherein the monitoring means comprises a monitoring circuit arranged in one of the securing parts for triggering the alarm upon disruption of a proper attachment monitored by the respective sensor element.

3. A device according to claim 1, wherein each sensor element is connected via an electrical connection to the respective securing part, and the securing parts are interchangeably attachable to the object and goods article surfaces.

4. A device according to claim 1, wherein the monitoring means is constructed so that an alarm is triggerable upon detachment of a proper cable connection between the securing parts.

5. A device according to claim 1, wherein at least one of the sensor elements comprises a photosensitive element.

6. A device according to claim 1, wherein the connection means is constructed so that a positive holding connection is able to be formed.

7. A device according to claim 1, wherein the connection means is constructed so that one of the securing parts is adapted to be suspended on the other.

8. A device according to claim 1, wherein the monitoring means comprises an energy storage means for supplying energy.

9. A device according to claim 1, wherein at least one of the securing parts comprises an optical display for displaying the operating status of the device.

10. A device according to claim 1, wherein at least one of the securing parts of the device is connectable to a monitoring circuit of an anti-theft system and/or further securing parts via a connection cable.

11. A system for securing goods against theft, comprising:

at least one device for securing goods according to claim 1, a central unit which has monitoring means including at least one monitoring circuit to which the at least one device is connectable via a connection cable, for detection of an alarm situation, and an alarm unit actuable by the monitoring circuit for emission of an acoustic and/or optical alarm signal.

12. A device according to claim 1, wherein the cable is connectable to the securing parts respectively by plug connection.

13. A device according to claim 12, wherein the monitoring means is constructed so that an alarm is triggerable upon disruption of a proper plug connection of the cable to the respective securing part.

14. A device according to claim 1, wherein the monitoring means comprises an alarm unit for the emission of an acoustic and/or optical signal.

15. A device according to claim 14, wherein the alarm unit comprises a piezoelectric crystal.

16. A device according to claim 1, wherein the monitoring means comprise a connection to a central unit, so that upon disruption of a proper attachment monitored by either one of said sensor elements an alarm is triggered through the central unit.

17. A device according to claim 16, wherein the connection comprises a cable for electrical connection.

18. A device according to claim 17 further comprising a connector, via which a connection with a further device having similar characteristics is possible so that several devices are connectable in series, whereby at least one of the devices is connected to the central unit.

19. A device according to claim 1, wherein at least one of the sensor elements comprises a microswitch.

20. A device according to claim 19, wherein a photosensitive element is arranged in the associated securing part so that the optical axis of the photosensitive element forms an acute angle of less than about 45° with an attachment face formed by the surface element.

21. A device according to claim 20, wherein the optical axis intersects an essentially central region of the attachment face.

22. A device according to claim 1, wherein at least one of the securing parts comprises a surface element for attachment to the object or the goods article.

23. A device according to claim 22, wherein the surface element is constructed to be flexible.

24. A device according to claim 23, wherein the sensor element of one of the securing parts comprises a wire strain gauge associated with the flexible surface element.

25. A device according to claim 22, wherein the surface element comprises an adhesive layer for attachment of the at least one securing part to the object or the goods article.

26. A device according to claim 25, wherein:

the adhesive layer is constructed so that it adheres more strongly to the object or the goods article than to the surface element; and the associated sensor element is arranged, at least in sections, in such a way between the surface element and the adhesive layer, or in the latter, that upon disruption of the proper attachment, the sensor element is separated from the securing part at least partially with the adhesive layer, and thus a measurement loop formed by the sensor element is interrupted.

27. A device according to claim 26, wherein the adhesive layer has predetermined breaking points.

28. A device according to claim 26, wherein the sensor element comprises an electrical, in particular metal foil type, conductor loop.

29. A device according to claim 25, wherein:

the adhesive layer is constructed so that it adheres more strongly to the object or the goods article than to the surface element; and the associated sensor element is constructed and arranged on the securing part in such a way that upon disruption of the proper attachment, the adhesive layer is at least partially separated from the securing part, and this is detectable by the associated sensor element.

30. A device according to claim 25, wherein at least one of the sensor elements comprises a light source, which is arranged in a recess of the associated securing part so that light leakage through the adhesive layer or a surface of the goods article or object is coverable in a light-tight manner.

31. A device according to claim 30, wherein the light source and a photosensitive element form a structural unit and are arranged in said recess in such a way that upon proper attachment of the associated securing part, light signals emitted by the light source are reflected on the adhesive layer and detected by the photosensitive element.

32. A device according to claim 1, wherein the monitoring means comprises a transmitter for emission of a transmission signal indicating an alarm situation.

33. A device according to claim 32, wherein the monitoring means is constructed so that the transmission signal is adapted to be encoded for identification of the device.

34. A system for securing goods against theft, wherein at least one device for securing the goods according to claim 32 is provided in combination with a central unit which comprises a receiver for wireless receipt of said transmission signal and for detection of an alarm situation, and an alarm unit for emission of an acoustic and/or optical alarm signal.

35. A system according to claim 34, wherein:

the monitoring means is constructed so that the transmission signal is encoded for identification of the device, and the central unit comprises a decoder and a display device which is actuable thereby, so that the device detecting an alarm situation is identifiable by the central unit on the basis of its transmission signal.

36. A system according to claim 35 wherein the central unit and at least one device securing the article are constructed so that the identification code of each device is recognizable by the decoder in the case of first time or test emission of a coded transmission signal by the at least one device, and is storable for later identification in the case of an alarm situation.

* * * * *

UNITED STATES PATENT AND TRADEMARK OFFICE

CERTIFICATE OF CORRECTION

PATENT NO. : 5,910,768

DATED : June 8, 1999

INVENTOR(S) : Reinhold Ott

It is certified that error appears in the above-indentified patent and that said Letters Patent is hereby corrected as shown below:

Title page, item [30], Priority Data:

Apr. 4, 1995 [DE] Germany.....196 12 567 should read:

Apr. 4, 1995 [DE] Germany.....195 12 567

Signed and Sealed this

Sixteenth Day of November, 1999

*Attest:*

*Attesting Officer*

Q. TODD DICKINSON

*Acting Commissioner of Patents and Trademarks*